US009822548B1

(12) United States Patent
Harkins

(10) Patent No.: US 9,822,548 B1
(45) Date of Patent: Nov. 21, 2017

(54) BARRIER WALL SYSTEM AND METHOD

(71) Applicant: John Harkins, West Palm Beach, FL (US)

(72) Inventor: John Harkins, West Palm Beach, FL (US)

( * ) Notice: Subject to any disclaimer, the term of this patent is extended or adjusted under 35 U.S.C. 154(b) by 0 days.

(21) Appl. No.: 15/427,517

(22) Filed: Feb. 8, 2017

(51) Int. Cl.

| | |
|---|---|
| ***E01F 13/00*** | (2006.01) |
| ***E04H 17/14*** | (2006.01) |
| ***E04H 17/16*** | (2006.01) |
| ***E04B 2/72*** | (2006.01) |
| ***E04B 2/74*** | (2006.01) |
| ***E01F 15/08*** | (2006.01) |

(52) U.S. Cl.
CPC ..... *E04H 17/166* (2013.01); *E01F 13/00* (2013.01); *E01F 15/088* (2013.01); *E04B 2/72* (2013.01); *E04B 2/7416* (2013.01)

(58) Field of Classification Search
CPC . E01F 13/00; E01F 15/00; E01F 15/02; E01F 15/08; E01F 15/085; E01F 15/088; E01F 15/081; E01F 15/14; E04H 17/14; E04H 17/16; E04H 17/161; E04H 17/165
See application file for complete search history.

(56) References Cited

U.S. PATENT DOCUMENTS 3,379,105 A * 4/1968 Lynch ..... E01C 11/222 256/13.1
4,553,875 A * 11/1985 Casey ..... E01F 15/083 249/5
4,806,044 A * 2/1989 Duckett ..... E01F 15/006 16/361
5,054,954 A * 10/1991 Cobb ..... E01F 15/083 256/13.1
5,131,133 A * 7/1992 Peterson ..... F24H 9/06 248/126
5,494,371 A * 2/1996 Oberth ..... E01F 15/146 256/13.1
5,531,540 A * 7/1996 Wasserstrom ..... E01F 15/088 256/13.1

(Continued)

FOREIGN PATENT DOCUMENTS

EP 0 474 572 * 3/1992 ..... E04H 17/16
EP 0 997 582 * 2/2000 ..... E01F 15/08

(Continued)

*Primary Examiner* — Michael P Ferguson
(74) *Attorney, Agent, or Firm* — Michael B. Fein; Eckert Seamans Cherin & Mellott, LLC

(57) ABSTRACT

A barrier system constructed of modules which includes a frame, a concrete foundation, a frame attached to the concrete foundation and supporting a non-vertical front side plate and a vertical rear side plate so that the front side plate and rear side plate meet at the top and are spread apart from each other at the bottom, slotted connectors on the front side and connectors on the rear side, the module adapted to be joined to an adjacent module either at the same elevation or a different elevation. The modules are joined together via bolts in the rear side connectors and threaded toggle bolts and drop toggle nuts through the front side slotted connectors. Extenders within the slots of the open ended connectors are used when connecting adjacent modules at different elevations to accommodate for slotted connectors of different sizes which must be connected to each other.

5 Claims, 16 Drawing Sheets

(56) References Cited

U.S. PATENT DOCUMENTS

| | | | | |
|---|---|---|---|---|
| 6,669,402 | B1 * | 12/2003 | Davis | E01F 15/088 256/13.1 |
| 6,782,624 | B2 | 8/2004 | Marsh et al. | |
| 6,851,887 | B2 * | 2/2005 | Lembo | E01F 15/088 404/6 |
| 8,875,451 | B1 * | 11/2014 | Parduhn | E04H 12/2223 52/157 |

FOREIGN PATENT DOCUMENTS

| | | | | |
|---|---|---|---|---|
| EP | 1 455 021 | * | 9/2004 | E01F 15/08 |
| GB | 2 094 849 | * | 9/1982 | E04H 17/16 |

* cited by examiner

BARRIER WALL SYSTEM AND METHOD

BACKGROUND OF THE INVENTION

This invention relates to the field of barrier systems designed to prevent entry by unauthorized persons and vehicles into protected property.

Prior barrier systems consisted of fences, concrete walls, and the like, which suffered from deficiencies such as penetrability, cost, and long construction periods required.

SUMMARY OF THE INVENTION

The present invention can be constructed and installed at lower cost and within shorter time periods than prior barrier systems and comprises in one aspect a barrier system comprising at least one module which includes a frame, a concrete foundation, a frame attached to the concrete foundation and supporting a non-vertical front side plate and a vertical rear side plate on a frame so that the front side plate and rear side plate meet at the top of the frame and are spread apart from each other at the bottom, slotted connectors on the front side and connectors on the rear side, the module adapted to be joined to an adjacent module either at the same elevation or a different elevation.

The barrier modules can be prefabricated in factories and shipped in one piece for field erection for expedient, rapid, and safer installation, made possible by the unique and adjustable end connectors which insures that each prefabricated module may be connected with each other as a true match at any variation in elevation in ground topography.

In some embodiments the modules include motion detection systems to detect any attempts at intrusion, vandalism, or attack, including underground tunneling attempts.

The rear plate is preferably a TG solid aluminum plate which is resistant to armor piercing bullets, is impervious to weather damage, and requires little or no maintenance.

In some embodiments, lightening arrestors are included at the top and connected to lightning ground rods. Barbed wire or other defensive devices are also optional.

Solar film elements can be applied to either or both sides of the module and collection wiring and terminal conversion to solar energy to transfer to local utilities is possible, which is an advantage of the modules and barrier wall of the invention since the modules include large flat areas suitable for solar energy systems. In some embodiments the slotted connectors include two holes for receiving bolts, one of which is distal and the other proximal, wherein the distal holes are aligned with an area within the frame and the proximal holes are forward of the front plate. The slotted connectors are arranged on the front side plate and vary in width, with the widest slotted connector nearest to the bottom of the module and above the concrete foundation, and the narrowest slotted connector nearest the top of the module. The slotted connectors have an open side and a closed side, with the open side being open toward the front of the module and the closed side fastened to the member of the frame supporting the rear side. The slotted connectors are designed to receive matching extenders within the slots. The extenders are used to compensate for differences in width when two modules at different elevations are to be joined together, in which case a proximal hole of a wider slotted connector is bolted to an extender in a slot of a less wide slotted connector, thereby allowing easy and efficient connection between modules at different elevations from each other.

Two modules can be joined to each other with bolts through the connectors on the rear side and toggle bolts through the proximal holes in the slotted connectors which are aligned with the area within the frame.

Modules at different elevations from each other can be joined together so that the top holes of one module are adjacent to the second, third, fourth, or fifth from top holes of a second module and the holes are connected with bolts when the holes are aligned.

Extender bars having forked ends can be located within the slots of the slotted connectors.

In the method aspect of the invention, a barrier wall system is constructed by placing prefabricated modules adjacent to one another and bolting them together. The modules can be at varying elevations with respect to the ground and due to the unique connector system the variations in elevation can be accommodated.

DETAILED DESCRIPTION OF THE INVENTION

Figure 1:
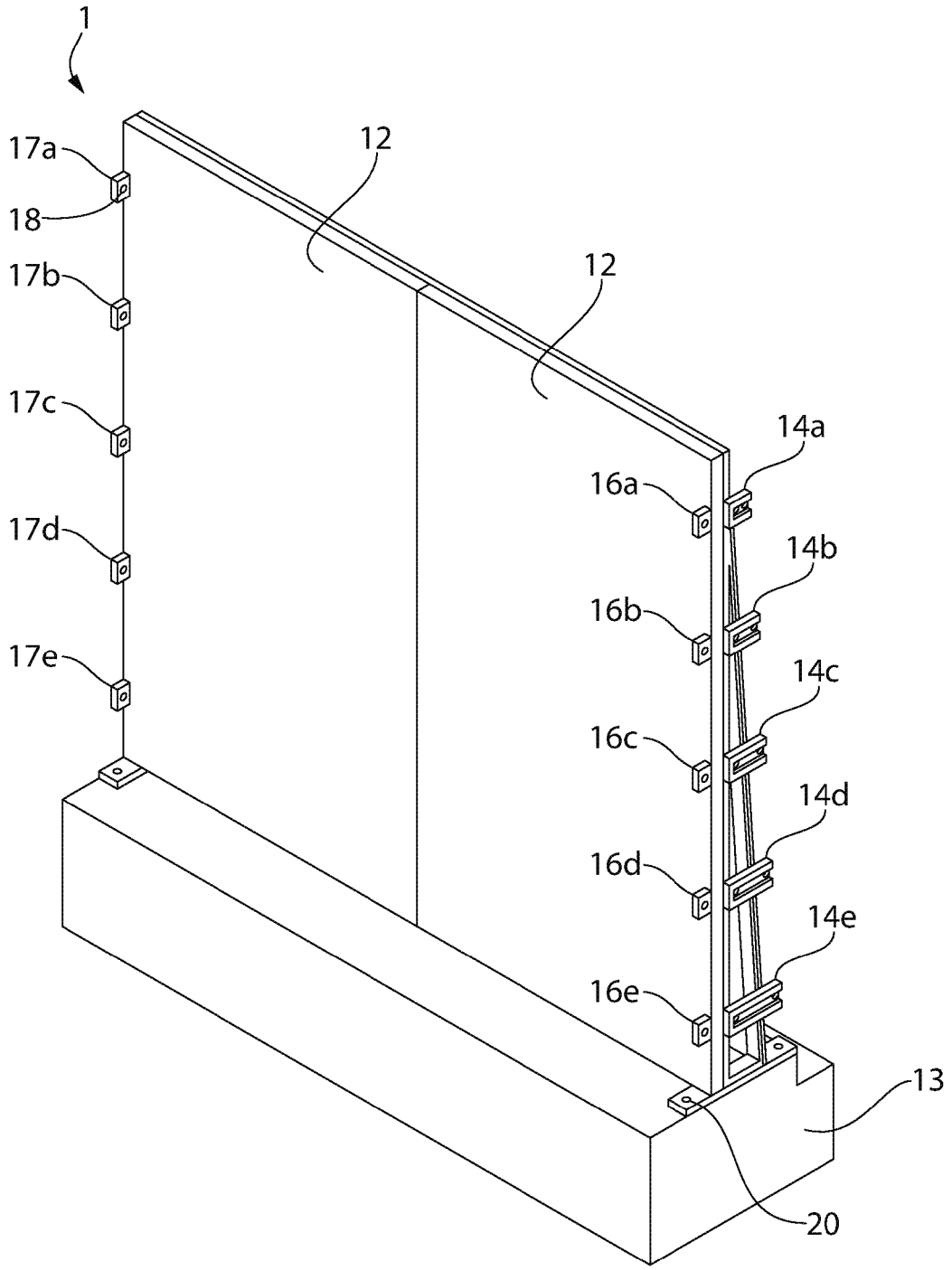
FIG. 1 is a perspective view of an embodiment of a barrier module according to the invention from the rear side.

Referring now to the drawings, FIG. 1 illustrates an embodiment of a barrier module 1 of the invention which includes rear side plates 12 which face the direction of the potential intruders. The rear side plates 12 and front side plates 11 (FIG. 2) are supported in a frame 21 (FIG. 3) which is attached via bolts 20 to a concrete foundation 13 which can be included in the prefabricated module. Left end rear side connectors 16*a*-16*e* and right end rear side are attached to rear side plates 12. Left end front side slotted connectors 14*a*-14*e* are attached to the front side plate 11 (FIG. 2) and the frame 21 (FIG. 3) so that one hole is adjacent to the triangular open area of the frame.

Figure 2:
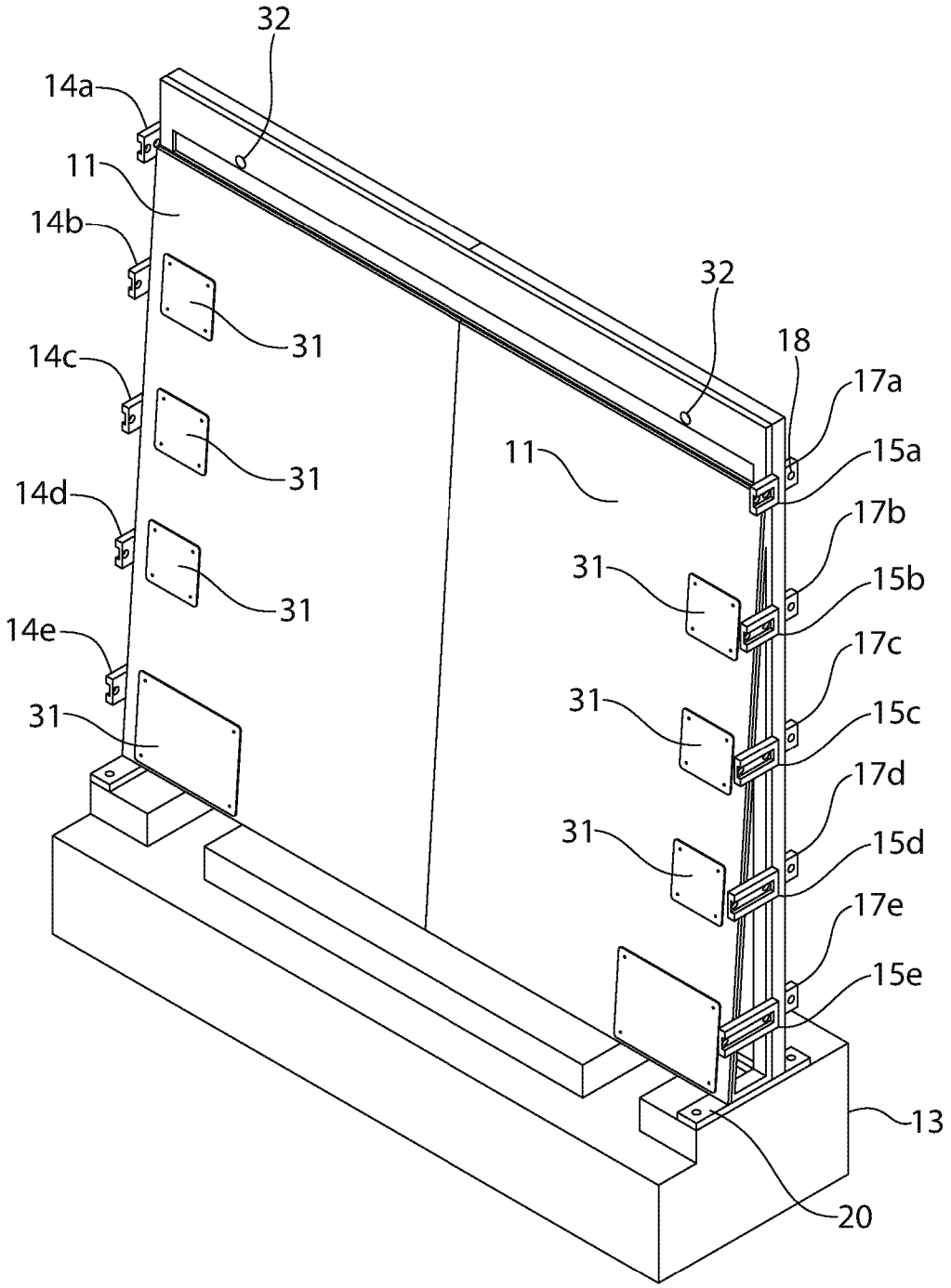
FIG. 2 is a perspective view of an embodiment of a barrier module according to the invention from the front side.

FIG. 2 illustrates the front side of the module 1 wherein front side plates 11 are supported on the frame at an angle off of vertical. Left end front side slotted connectors 14*a*-14*e* are shown in this view, as are right end front side slotted open-ended connectors 15*a*-15*e* and right end rear side connectors 17*a*-17*e*. Connectors' 15*a*-15*e* include holes 18 for receiving bolts to join adjacent modules. The bottom of the frame 20 is joined by bolts to concrete foundation 13.

Two holes 32 per module for crane hooks are shown in this view, as are access panels 31 which are only on the front side panels 11.

Figure 3:
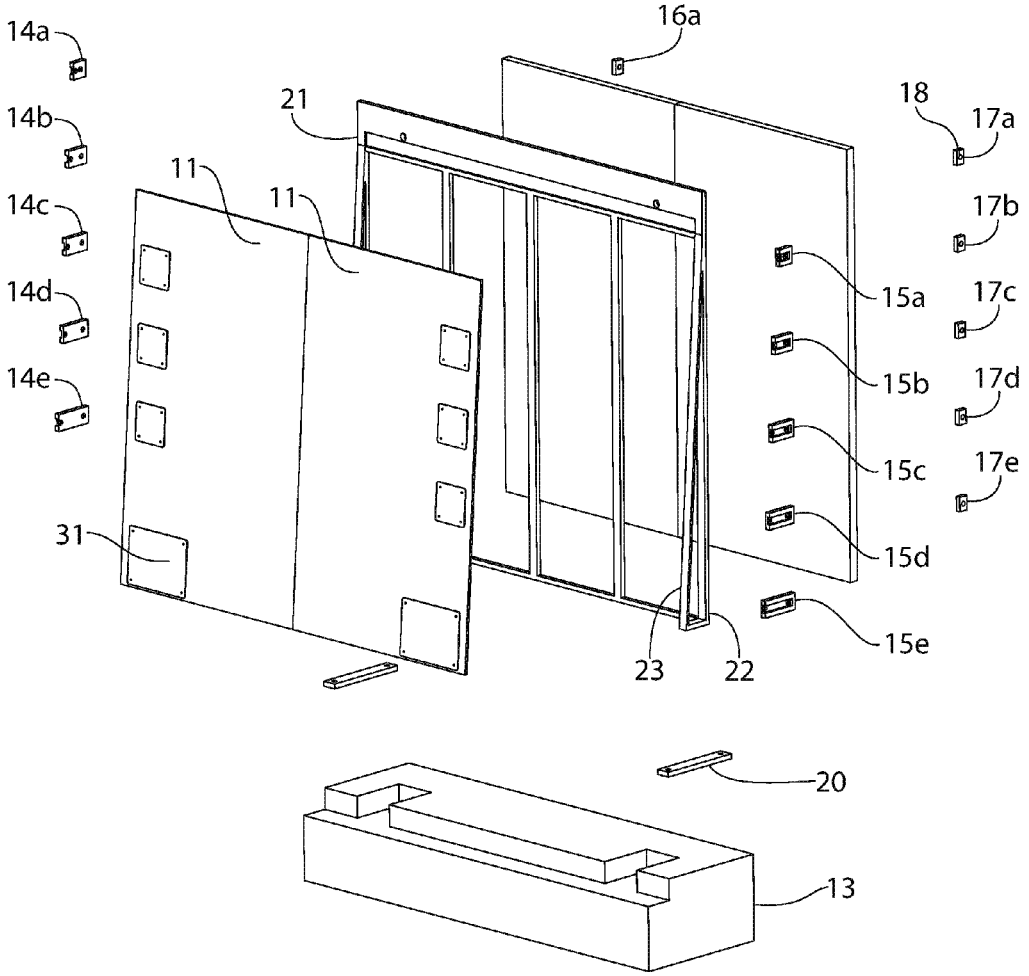
FIG. 3 is an exploded perspective view of the barrier module from the rear side.

FIG. 3 shows separate parts of the module which include front side panels 11 which have access panels 31 and open-ended connectors 14*a*-14*e* and 15 *a*-15*e*. Right end rear side connectors 17*a*-17*e* are shown but only one left end rear side connector 16*a* is visible in this view. Frame 21 includes rear side frame support member 23 and front side support member 22, and is connected with frame bottom member 20 to concrete foundation 13.

Figure 4:
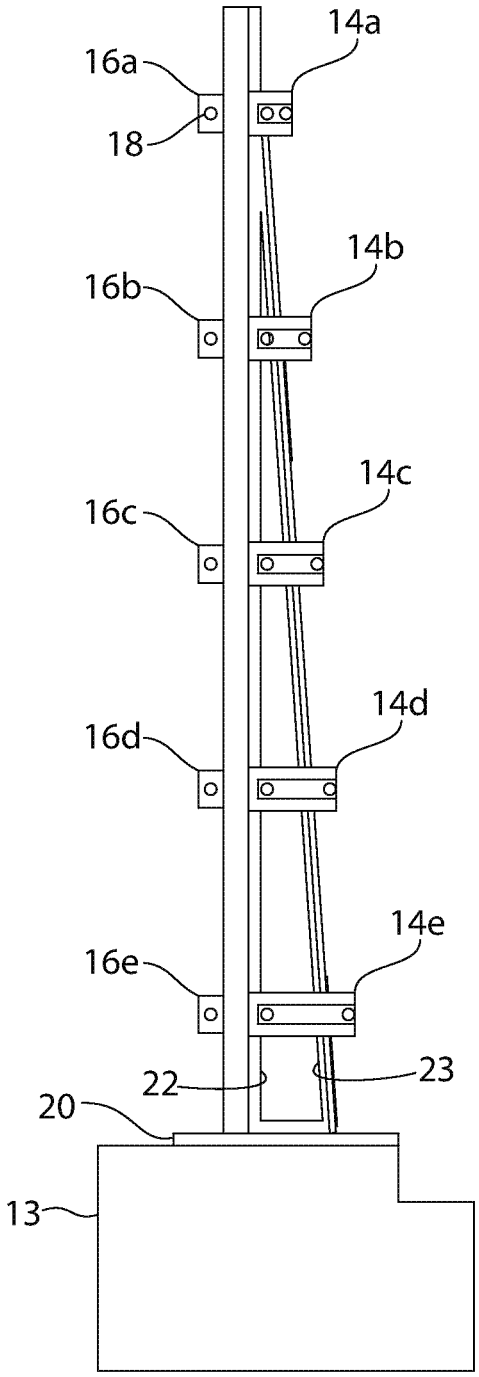
FIG. 4 is a side elevational view of a barrier module embodiment with the rear side on the left.

FIG. 4 is a side perspective view of a module 1 in which the detail of the construction of the triangular frame are shown.

Figure 5:
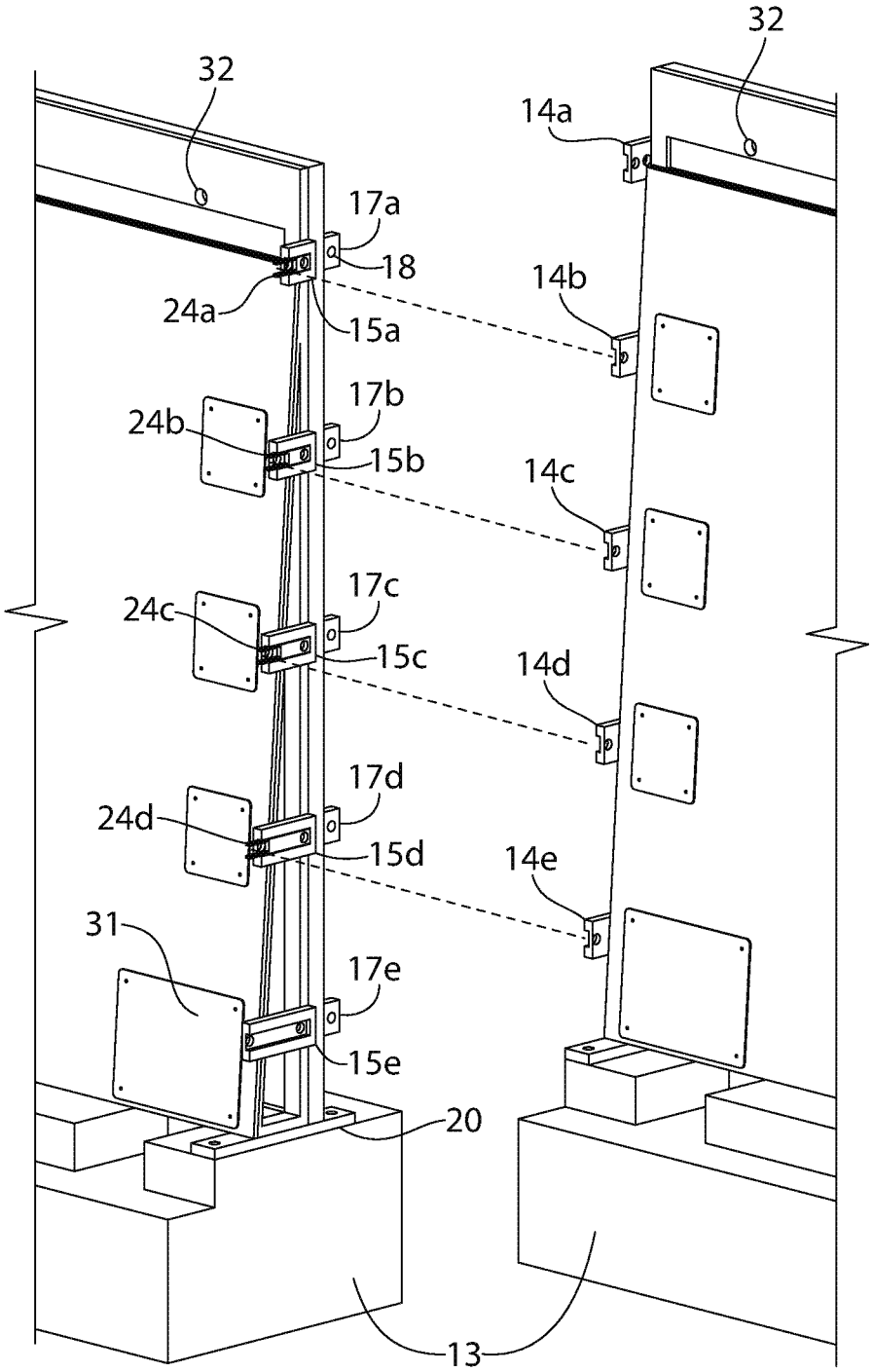
FIG. 5 is a perspective view of two modules of the invention at different elevations, illustrating an assembly configuration.

FIG. 5 is a perspective view of two modules of the invention at different elevations, illustrating an assembly configuration wherein member 14*b* will be connected to member 14*a*, etc.

Figure 6:
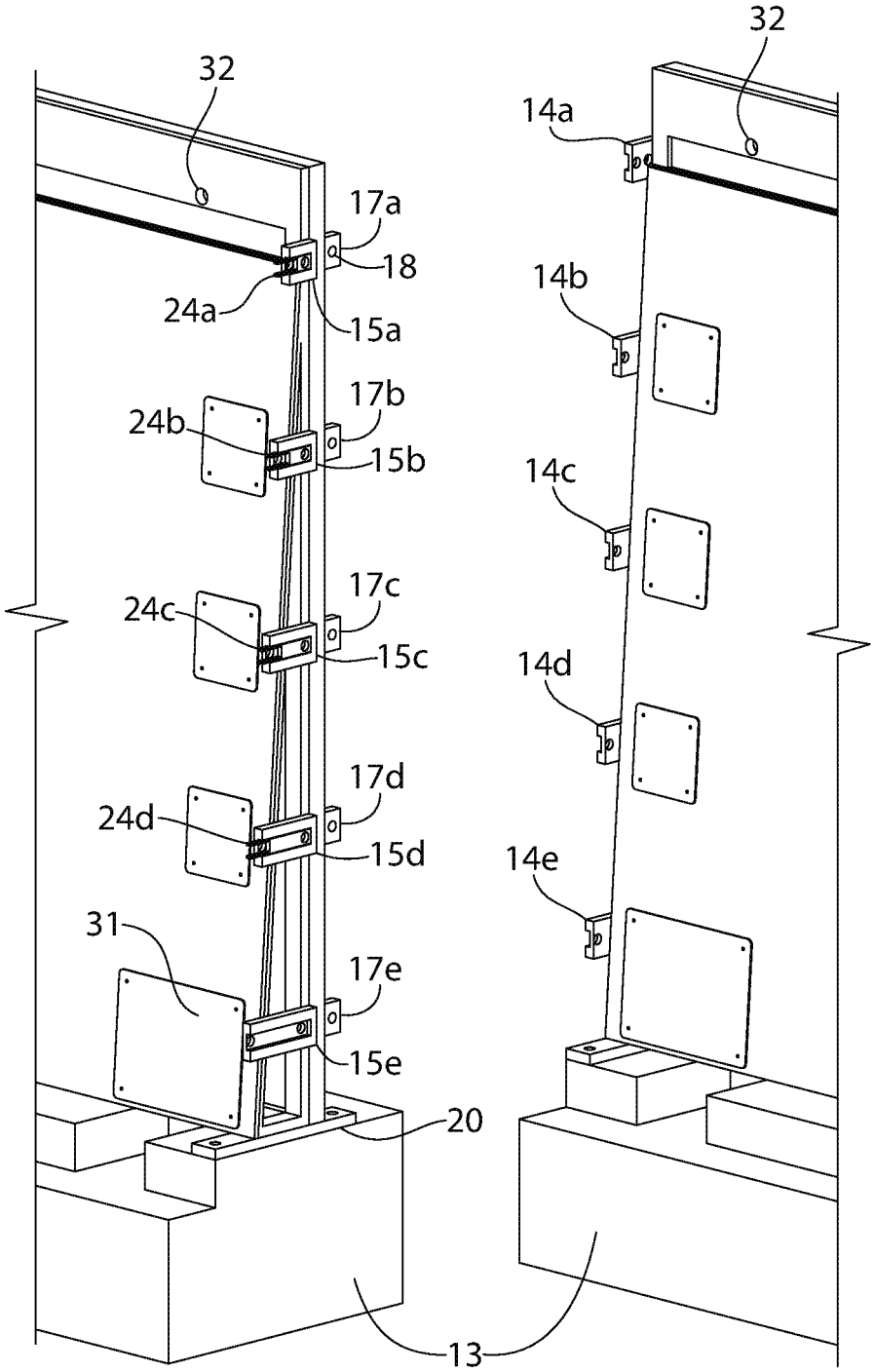
FIG. 6 is a view of the two modules of FIG. 5 prior to assembly with each other.

FIG. 6 is a view of the two modules of FIG. 5 prior to assembly with each other.

Figure 7:
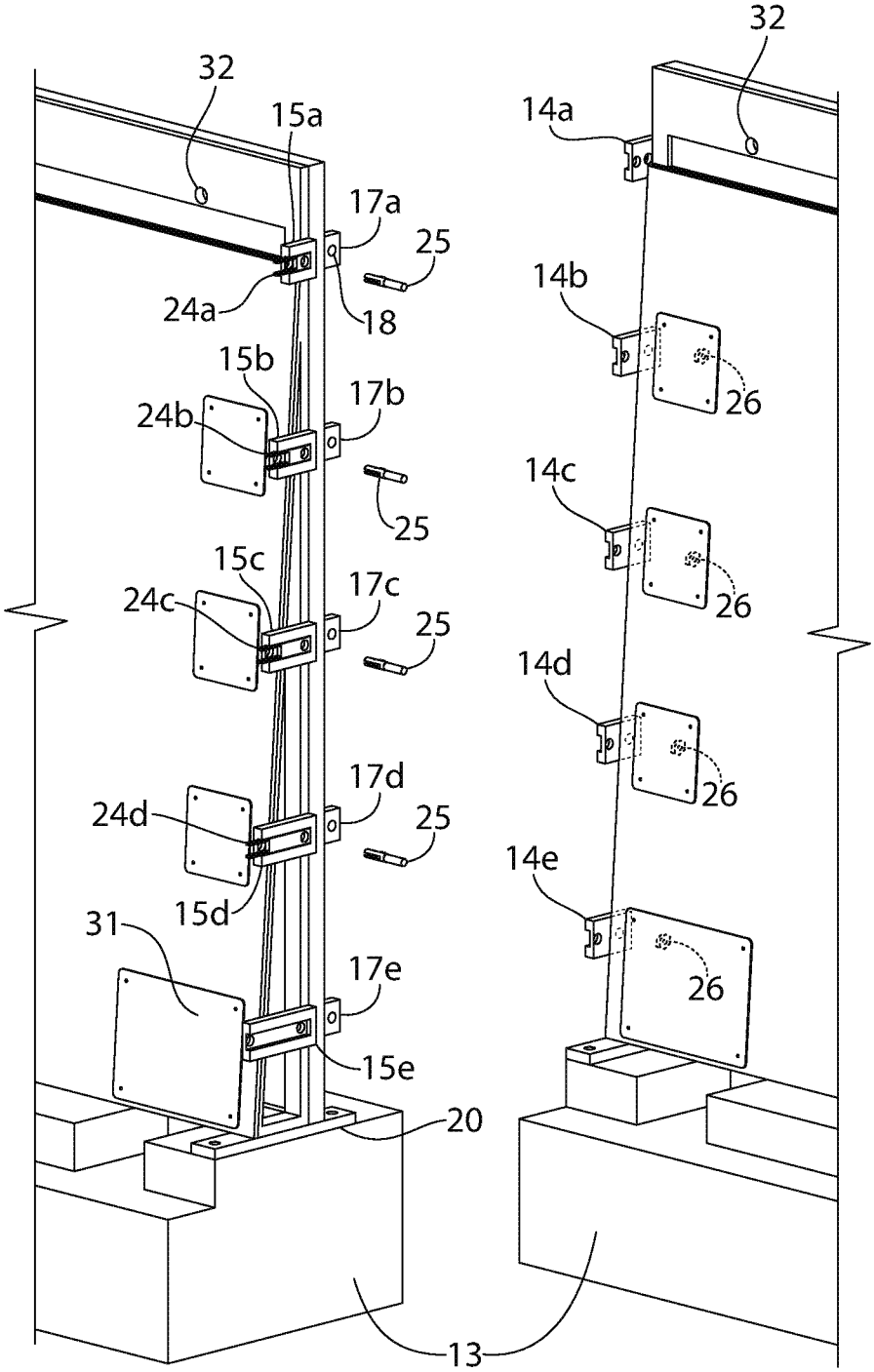
FIG. 7 is a perspective view of the two adjacent modules of FIG. 5, showing placement of toggle bolts placement in the blind holes in front side slotted open-ended connectors.

FIG. 7 is a perspective view of the two adjacent modules of FIG. 5, showing placement of toggle bolts 25 being inserted in the blind holes in front side slotted open-ended connectors 24*a*-24*d*, connecting open-ended connectors 14*b*-14*e*, respectively. Drop toggle nuts 26 are used on the front side of open ended members 14*b*-1.4*e* when the drop toggle bolts 25 are inserted. Extender bars 24*a*-24*d* are shown inserted in the slots of rear side slotted open-ended connectors 15*a*-15*d*, respectively.

Figure 8:
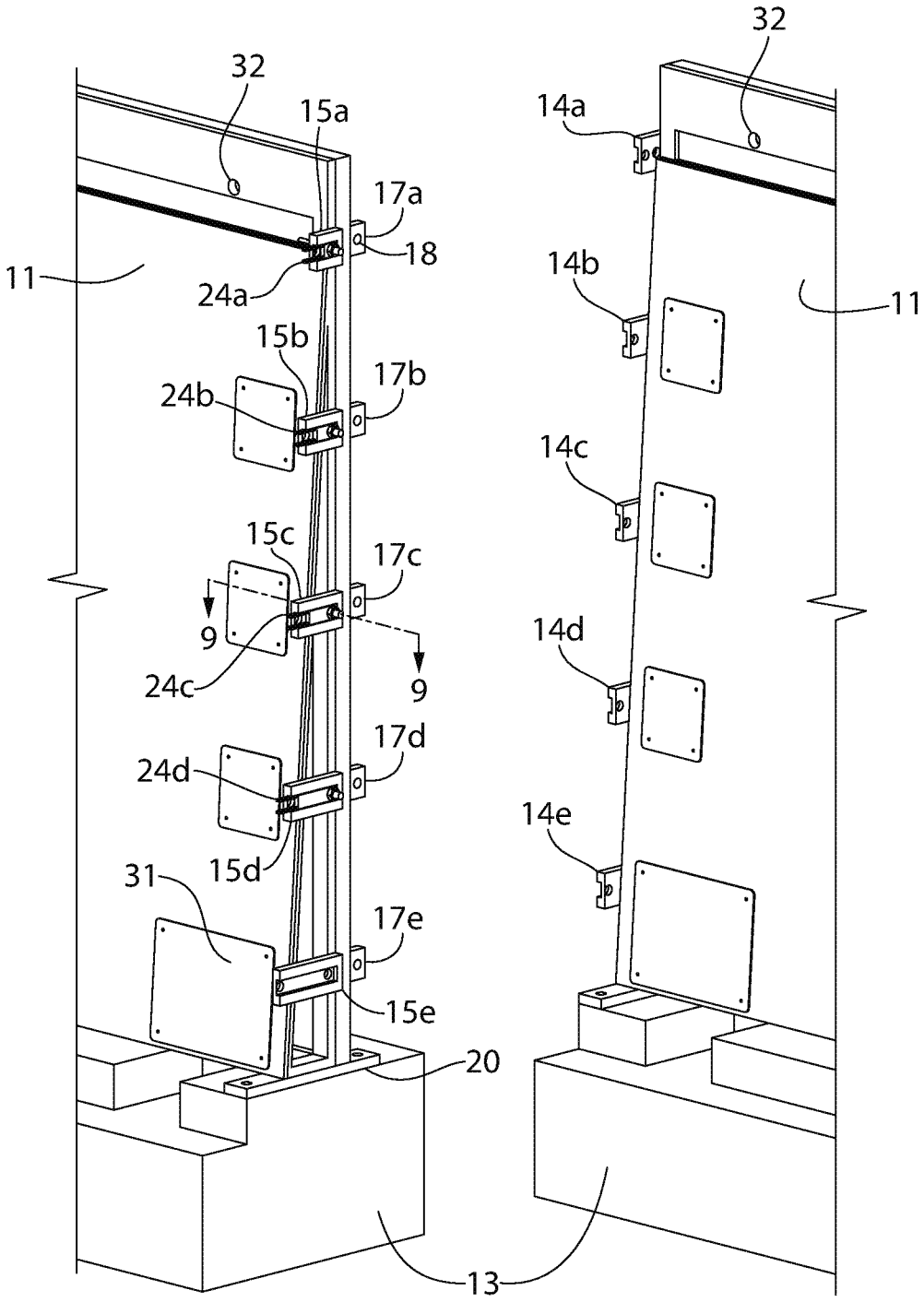
FIG. 8 is a perspective view of the two adjacent modules of FIG. 7 with the toggle bolts placed in the blind side holes in front side slotted open-ended connectors.

FIG. 8 is a perspective view of the two adjacent modules 1 of FIG. 7 with the toggle bolts placed in the blind side holes in front side slotted open-ended connectors 15*a*-15*d*.

Figure 9A:
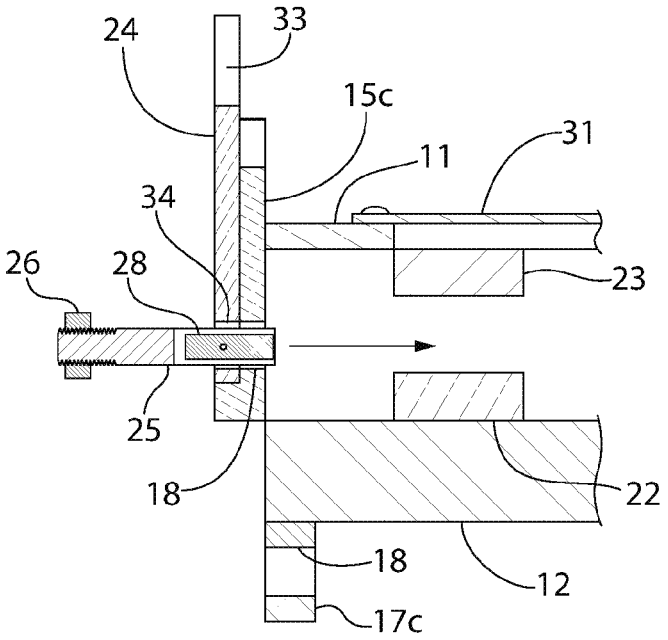
FIG. 9A is a cross-sectional view through 9-9 of FIG. 8 showing insertion of toggle bolts into blind holes in open-ended connectors.

FIG. 9A is a cross-sectional view through 9-9 of FIG. 8 showing insertion of toggle bolts into blind holes 34 in extender bar 24. Front side plate 11 is supported on front side frame support member 23. Drop toggle bolt 25 includes off center toggle member 28 supported on a pivot and drop toggle nut 26. Front side frame support member 22 and rear (rear) side plates 12 and right end rear side connector 17*c* having hole 18 are shown on the rear side plate 12.

Figure 9C:
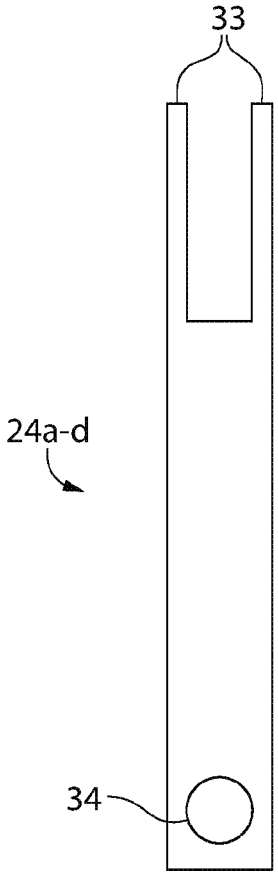
FIG. 9C is a plan view of extender 15*d* of FIG. 8, which is longer than 15*c*, which in turn is longer than 15*b*, which in turn is longer than 15*a*.
Figure 9B:
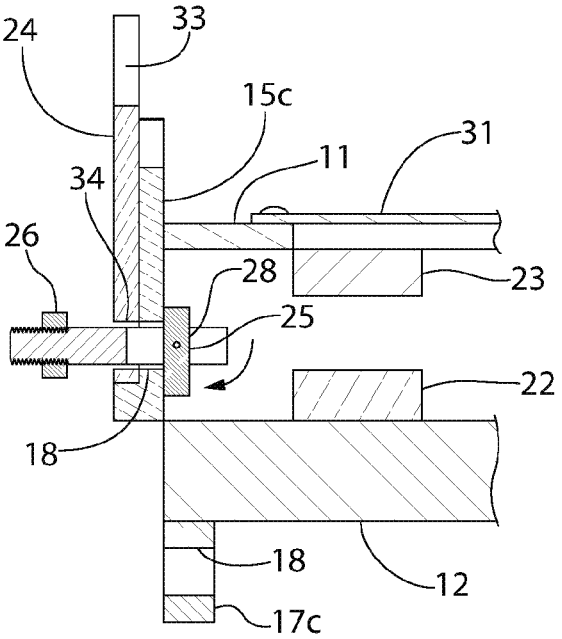
FIG. 9B is a cross-sectional view through 9-9 of FIG. 8 showing toggle pivot deployed.

FIG. 9B is a cross-sectional view through 9-9 of FIG. 8 showing toggle pivot deployed.

FIG. 9C is a plan view of extender 24*d* of FIG. 8, which is longer than 24*c*, which in turn is longer than 24*b*, which in turn is longer than 24*a*, matching the lengths of the corresponding slots 15*d*-15*a* (FIG. 6), respectively.

Figure 10:
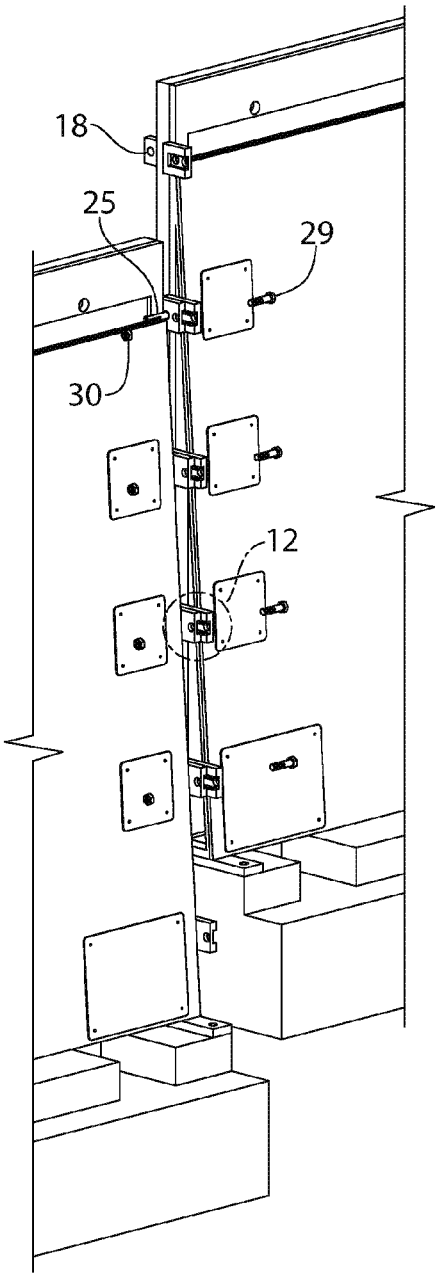
FIG. 10 is a perspective view from the front side of sections of two adjacent modules at different elevations from each other.

FIG. 10 is a perspective view from the front side of sections of two adjacent modules 1 at different elevations from each other with bolts 29 and nuts 30 aligned to be connected. Toggle bolt 25 is shown being inserted into the distal hole of the upper most slotted connector.

Figure 11:
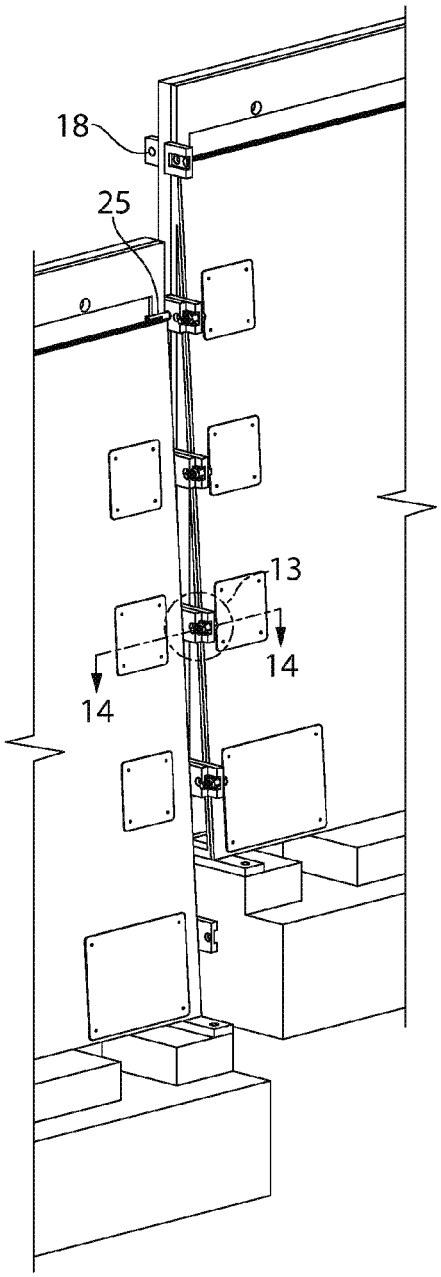
FIG. 11 is a perspective view from the front side of the sections of the two adjacent modules of FIG. 10 having been connected with bolts.

FIG. 11 is a perspective view from the front side of the sections of the two adjacent modules 1 of FIG. 10 having been connected with bolts 29 and nuts 30.

Figure 12:
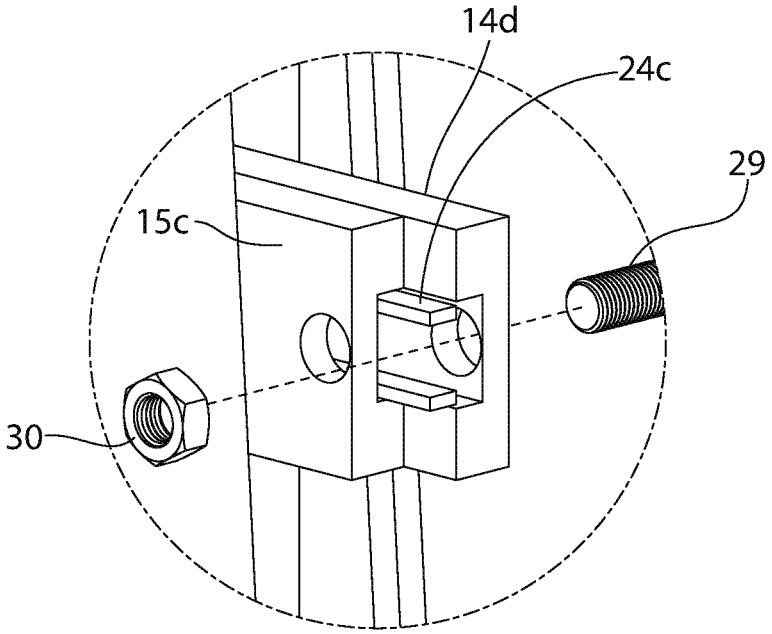
FIG. 12 is a magnified view of area 12 of FIG. 10.

FIG. 12 is a magnified view of area 12 of FIG. 10 showing detail of the bolt 29 going through hole and the forks of the open ended extender bar 24*c* which has been inserted into the slot of slotted connector 15*c*. Since 14*d* is wider than 15*c*, when the proximal hole of slotted connector 14*d* cannot be aligned with the proximal hole of slotted connector 15*c*, which problem is solved by the present invention which includes the extender 24*c* within the slot of slotted connector 15*c*.

Figure 13:
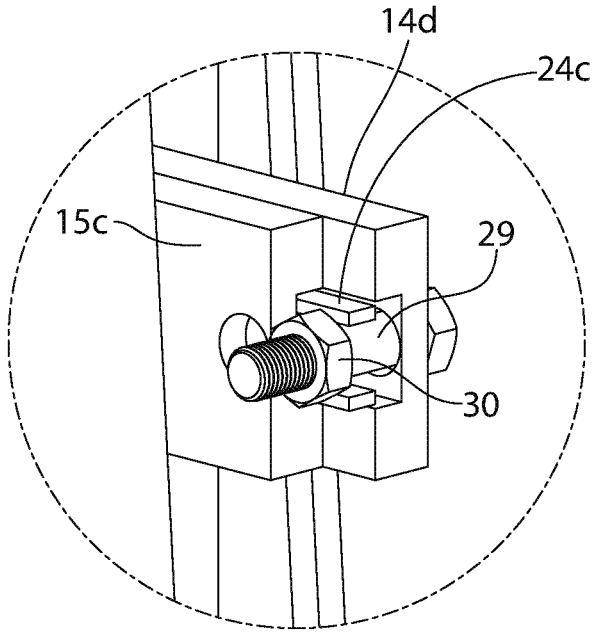
FIG. 13 is a magnified view of area 12 of FIG. 11.

FIG. 13 is a magnified view of area 12 of FIG. 11 with bolt 29 and nut 30 joined through the proximal hole to hold slotted connector 14*d* to the forked end of extender bar 24*c*.

Figure 14A:
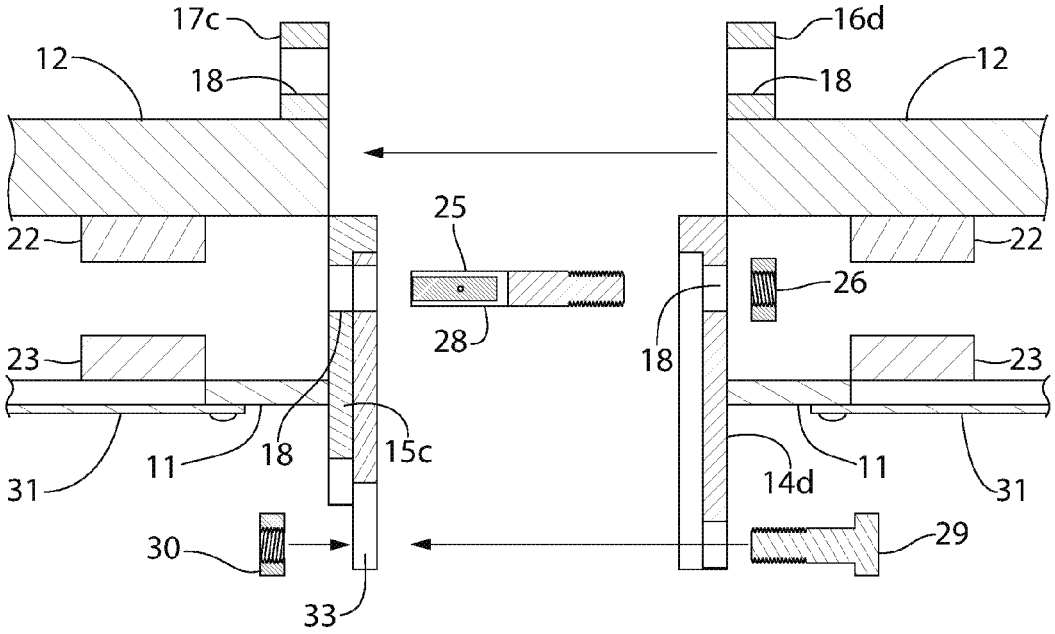
FIGS. 14A and 14B are a cross-sectional views through 14-14 of FIG. 11.

FIG. 14A is a cross-sectional view through 14-14 of FIG. 11 showing bolt 29 being joined with nut 30 and toggle drop bolt 25 being inserted through slotted connector 15*c* to secure slotted connectors 14*d* to 15*c*.

Figure 14B:
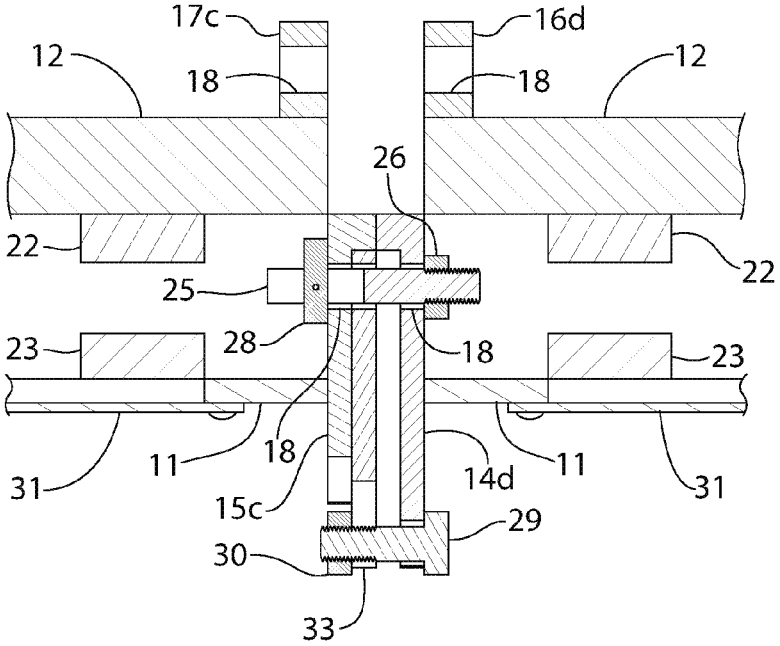

FIG. 14B is a cross-sectional view of the two slotted connectors, 14*d* and 15*c*, having been connected with bolt 29 and nut 30 and toggle bolt 25.

Figure 15:
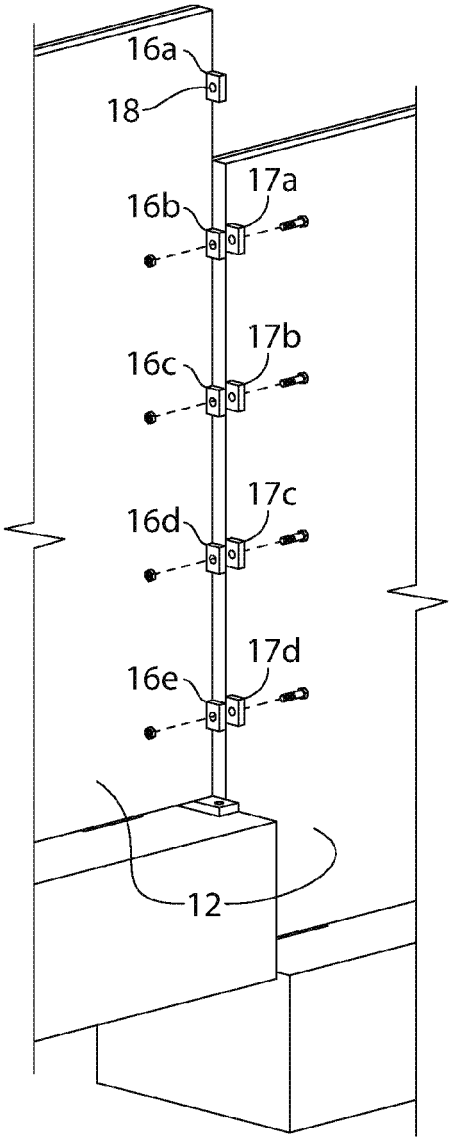
FIG. 15 is a perspective view from the rear side of the sections of the two adjacent modules of FIG. 10 at different elevations from each other.

FIG. 15 is a perspective view from the rear side plates 12 of the sections of the two adjacent modules of FIG. 10 at different elevations from each other having been connected with bolts and nuts through left rear side connectors 16*b*-16*e* of the left module and right end rear side connectors 17*a*-17*d* of the right module.

Figure 16:
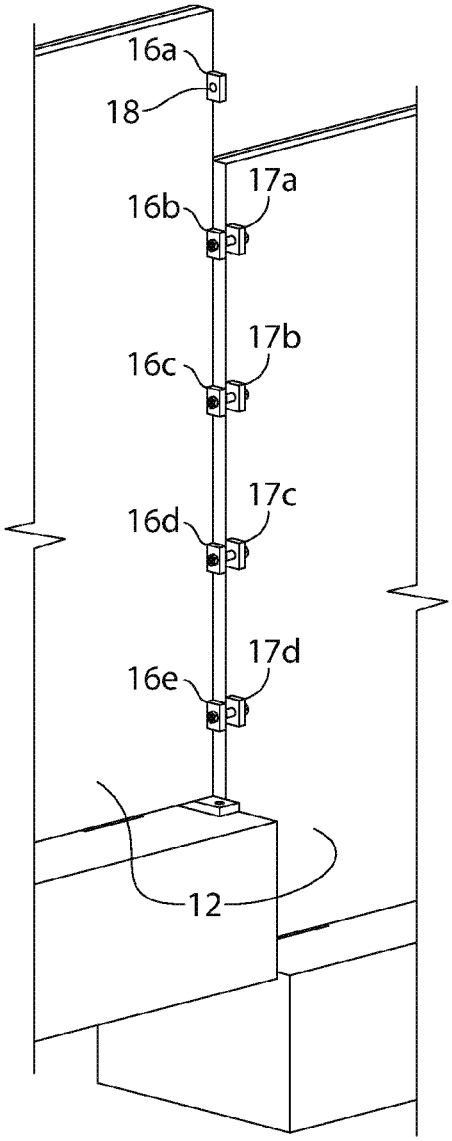
FIG. 16 is a perspective view from the rear side of the sections of the two adjacent modules of FIG. 10 at different elevations from each other having been connected with bolts.

FIG. 16 is a view of the sections of modules of FIG. 15 having been connected with the bolts and nuts.

Figure 17:
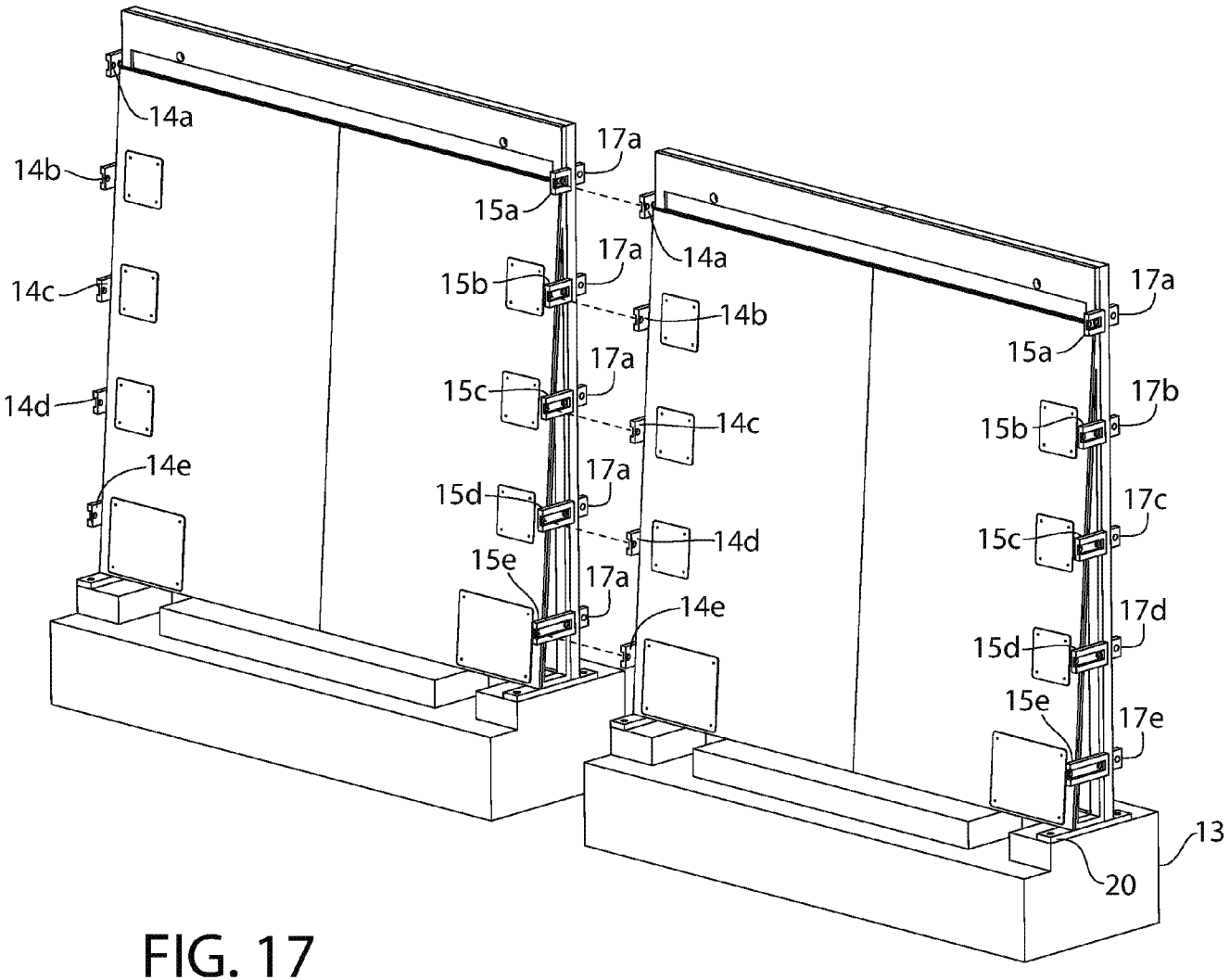
FIG. 17 is a perspective view of the front side of two adjacent modules at the same elevation prior to being connected to each other.

FIG. 17 is a perspective view of the front side of two adjacent modules at the same elevation prior to being connected to each other, with the left side connectors of the right module about to be joined with the right side connectors of the left module.

Figure 18:
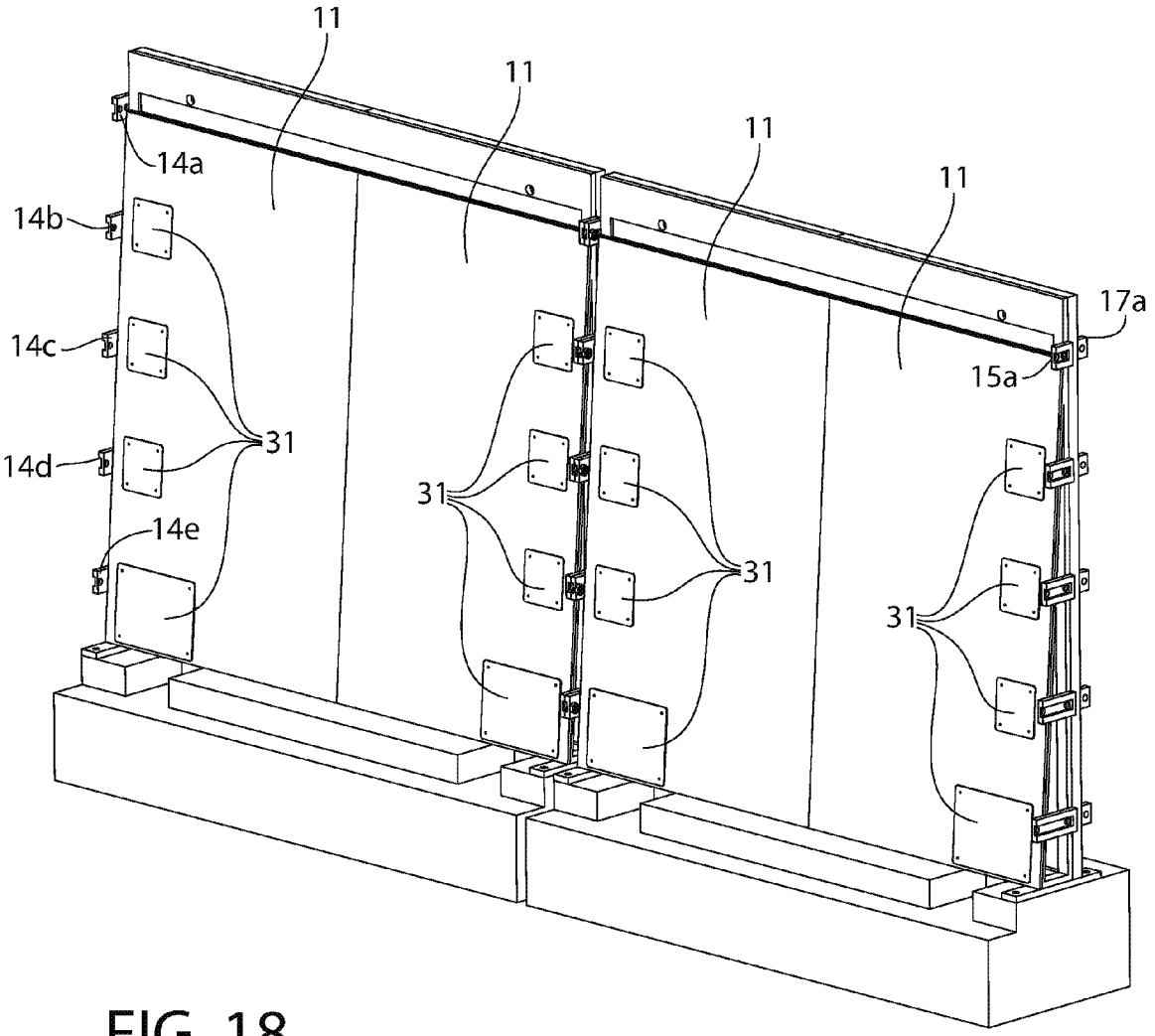
FIG. 18 is a perspective view of the two adjacent modules of FIG. 17 after connection to each other.

FIG. 18 is a perspective view of the two adjacent modules of FIG. 17 after connection to each other.

Figure 19:
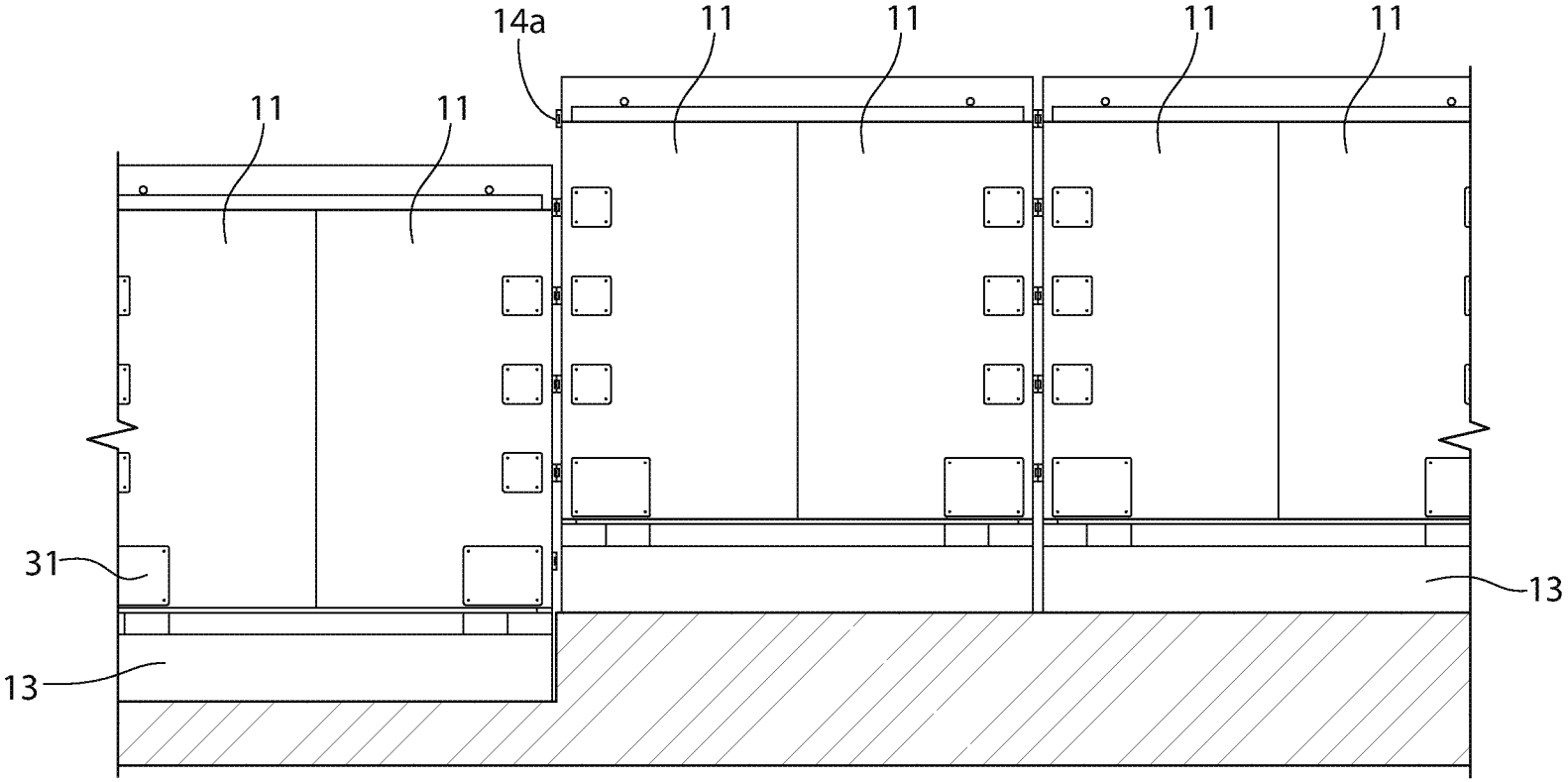
FIG. 19 is a front side elevational view of three connected modules, two of which being at the same elevation.

FIG. 19 is a front side elevational view of three connected modules, the left two of which being at the same elevation and the right module being at a lower elevation. Connector 14*a* is seen not being connected to an adjacent connector.

The present invention, therefore, is well adapted to carry out the objectives and attain the ends and advantages mentioned, as well as others inherent therein. While the invention has been depicted and described and is defined by reference to particular embodiments of the invention, such references do not imply a limitation on the invention, and no such limitation is to be inferred. Consequently, the invention is intended to be limited only by the spirit and scope of the appended claims, giving full cognizance to equivalents in all respects.

What is claimed is:

1. A barrier system comprising:

at least one module, each comprising:

a frame having opposing ends, each end comprising a triangular support comprising a vertical leg, a non-vertical leg and a horizontal bottom leg attached to a concrete foundation, a non-vertical front side plate supported on a front side of the module, having opposing ends each attached to the non-vertical leg of one of the supports, and a vertical rear side plate supported on a rear side of the module, having opposing ends each attached to the vertical leg of one of the supports, wherein the front side plate and rear side plate meet at a top of the module and are spread apart from each other at a bottom of the module, single-holed connectors disposed along each end of the rear side plate on the rear side, and slotted connectors disposed along each end of the front side plate on the front side, each comprising an open-ended slot having a proximal hole and a distal hole disposed therein, wherein the distal holes of the slotted connectors are aligned with an area within the frame, and wherein the length of the slot and the distance between the proximal and distal holes of each slotted connector increases from the top to the bottom of the module, wherein the module is adapted to be joined to an adjacent module either at the same elevation or a different elevation; and extender bars for joining adjacent modules at a different elevation, each adapted to be disposed within the slot of a respective slotted connector of a lower elevation module, and comprising a distal hole aligned with the distal hole of the slotted connector, and an open end extending from the slot for engaging a nut aligned with the proximal hole of a corresponding slotted connector of a higher elevation module.

2. The system of claim 1 comprising at least two modules joined to each other with bolts through the single-holed connectors on the rear side of the modules and toggle bolts through the distal holes in the slotted connectors which are aligned with the area within the frame.

3. The system of claim 1 comprising at least two modules at different elevations from each other which are joined together so that a top single-holed connector of one module is adjacent to a second from top single-holed connector of a second module and the single-holed connectors are connected with bolts when the single-holed connectors are aligned.

4. The system of claim 1 wherein the extender bars have forked ends.

5. A method of constructing a barrier wall system comprising providing at least two modules of the barrier system according to claim 1 and joining them by bolting through the rear side single-holed connectors and by inserting toggle bolts through the distal holes of the slotted front side connectors.

* * * * *